US005180402A

United States Patent [19]

Kubota et al.

[11] Patent Number: 5,180,402

[45] Date of Patent: Jan. 19, 1993

[54] DYED SYNTHETIC FIBER COMPRISING SILVER-SUBSTITUTED ZEOLITE AND COPPER COMPOUND, AND PROCESS FOR PREPARING SAME

[75] Inventors: Koichi Kubota; Tetsuya Katoh, both of Aichi; Masayuki Hirata, Kyoto; Kazuya Hayashi, Otsu, all of Japan

[73] Assignee: Toray Industries, Inc., Japan

[21] Appl. No.: 695,220

[22] Filed: May 3, 1991

[30] Foreign Application Priority Data

May 8, 1990 [JP] Japan ..... 2-119497

[51] Int. Cl.[5] ..... D06P 5/00; D01F 1/10

[52] U.S. Cl. ..... 8/490; 8/624; 8/680; 8/685; 8/924; 428/323; 523/122

[58] Field of Search ..... 523/122; 8/490, 624

[56] References Cited

U.S. PATENT DOCUMENTS 4,775,585 10/1988 Hagiwara et al. ..... 428/323
4,849,223 7/1989 Pratt ..... 424/409
4,906,464 3/1990 Yamamoto et al. ..... 424/78
4,911,898 3/1990 Hagiwara et al. ..... 423/118
4,938,955 7/1990 Niira et al. ..... 424/79
4,938,958 7/1990 Niira et al. ..... 424/79

*Primary Examiner*—A. Lionel Clingman
*Attorney, Agent, or Firm*—Austin R. Miller

[57] ABSTRACT

A dyed synthetic fiber having antibacterial and antifungal properties is described, which contains 0.01 to 20 weight % of a silver-substituted zeolite and 0.001 to 1.0 weight % of a substantially water-insoluble copper compound. The copper compound is present independent of zeolite particles in the fiber. The dyed synthetic fiber is prepared by incorporating a silver-substituted zeolite in a monomer or a polymerization mixture before the completion of polymerization in the step of preparing a polymer for the fiber; further incorporating the copper compound in the polymer before the spinning thereof into a fiber; spinning the polymer into a fiber; and dyeing the fiber. The dyed fiber retains a high level of antibacterial and antifungal properties.

16 Claims, No Drawings

DYED SYNTHETIC FIBER COMPRISING SILVER-SUBSTITUTED ZEOLITE AND COPPER COMPOUND, AND PROCESS FOR PREPARING SAME

BACKGROUND OF THE INVENTION (1) Field of the Invention

This invention relates to a dyed synthetic fiber having incorporated therein silver-substituted zeolite particles exhibiting an antibacterial and antifungal action, which fiber retains a high level of antibacterial and antifungal properties even though dyed, and to a process for preparing the dyed fiber.

(2) Description of the Related Art

It is known that fibers having incorporated therein antibacterial and antifungal silver ion-substituted zeolite particles and textile articles made therefrom exhibit a good antibacterial and antifungal action against microorganisms such as bacteria and fungi (see U.S. Pat. No. 4,775,585).

Antibacterial and antifungal composite zeolite particles having adsorbed therein a divalent metal ion such as a copper ion or zinc ion in addition to a silver ion through an ion exchange reaction also are often used because these divalent metal ions exhibit an antibacterial and antifungal action and a heat resistance, although the antibacterial and antifungal action is somewhat less than that of a silver ion.

Usually, a metal ion-substituted zeolite having adsorbed at least one metal exhibiting an antibacterial and antifungal action in the ion-exchangeable sites is incorporated in a polymer, the polymer is shaped into a fiber, a film or other shaped articles, and these shaped articles are dyed and finished.

However, fibers and other shaped articles prepared by a conventional procedure have a problem in that the antibacterial and antifungal action is reduced during the dyeing and finishing treatments. The degree of reduction of the antibacterial and antifungal action varies depending upon the particular dye, finishing agent and dyeing and finishing conditions, and especially, where dyed with acid dyes including metallized dyes and acid dyes (in a narrow sense), the antibacterial and antifungal action is reduced to a great extent and in some cases the antibacterial and antifungal action becomes almost zero.

SUMMARY OF THE INVENTION

Under the above-mentioned background, a primary object of the present invention is to provide a dyed synthetic fiber having incorporated therein a silver-substituted zeolite having an antibacterial and antifungal action, which retains a high level of antibacterial and antifungal properties even though the fiber is dyed.

Another object of the present invention is to provide a process for preparing the above-mentioned antibacterial and antifungal dyed synthetic fiber.

In accordance with the present invention, there is provided a dyed synthetic fiber having antibacterial and antifungal properties which comprises, based on the weight of the fiber, 0.01 to 20% by weight of a silver-substituted zeolite having an antibacterial and antifungal action and 0.001 to 1.0% by weight of a substantially water-insoluble copper compound; said substantially water-insoluble compound being present independent of zeolite particles in the fiber and the fiber being dyed with a dye.

In another aspect of the present invention, there is provided a process for preparing the above-mentioned antibacterial and antifungal dyed synthetic fiber, which comprises the steps of incorporating a silver-substituted zeolite having an antibacterial and antifungal action in a monomer or a polymerization mixture before the completion of polymerization in the step of preparing a polymer for the synthetic fiber; further incorporating a substantially water-insoluble copper compound in the polymer before the spinning thereof into a fiber, to prepare a polymer containing, based on the weight of the polymer, 0.01 to 20% by weight of the silver-substituted zeolite and 0.001 to 1.0% by weight of the copper compound, said copper compound being present independent of zeolite particles in the polymer; spinning the thus-prepared polymer into a fiber; and dyeing the fiber.

DESCRIPTION OF THE PREFERRED EMBODIMENTS

The dyed synthetic fiber of the present invention comprises a substantially water-insoluble copper compound independent of zeolite particles in the fiber. By the phrase "substantially water-insoluble copper compound", we mean that the compound is insoluble in water or soluble only in an amount of not larger than 100 mg per 100 g of water at a temperature of 20° C. By the phrase "the copper compound present independent of zeolite particles", we mean that the copper compound is not chemically bonded with a zeolite, i.e., not substituted by an ion exchange for the metal of a zeolite, but is dispersed in the fiber as a discrete compound from zeolite particles. When the fiber of the present invention is dissolved in a solvent, which does not decompose or deteriorate both the silver-substituted zeolite and the copper compound and the copper compound is separated from the silver-substituted zeolite in the solution, the copper compound can be recovered as the same compound in substantially the same amount as that of the compound before the addition thereof to the polymer.

To render the copper compound particles independent of zeolite particles in the fiber, the silver-substituted zeolite particles are added to a monomer before the initiation of polymerization or to a polymerization mixture before the completion of polymerization, and the copper compound is in the form of a powder, a dispersion or a solution to the polymer before spinning into a fiber. If a silver compound for the silver-substituted zeolite and the copper compound are mixed together with an unsubstituted zeolite to prepare an antibacterial and antifungal composite zeolite having both a silver ion and a copper ion at the cation-exchangeabe sites, or if an antibacterial and antifungal silver-substituted zeolite and an antibacterial and antifungal copper-substituted zeolite are separately prepared and mixed together, when these antibacterial zeolites are incorporated in the polymer, the copper compound is not independent of zeolite particles in the polymer and the dyed synthetic fiber retaining good antibacterial and antifungal properties, intended by the present invention, cannot be obtained.

If both the silver-substituted zeolite and the copper compound are incorporated in a monomer before the initiation of polymerization or a polymerization mixture before the completion of polymerization, then the copper compound is substituted for the metal of the zeolite and therefore an excessive amount of the copper compound must be incorporated to render an appreciable amount of the copper compound independent of the zeolite particles, which results in undesirable coloration of the fiber and discoloration with time of the fiber.

Zeolites used for the preparation of the silver-substituted zeolites used in the present invention are aluminosilicates having a three-dimensional skeletal structure predominantly comprised of $SiO_2$ and $Al_2O_3$, and may be either natural or synthetic. As the zeolites, there can be mentioned natural zeolites such as chabazite, clinoptilolite, erionite, faujasite and mordenite, and synthetic zeolites such as A type, X type, Y type, mordenite type, pentasil type, ferrierite type, beta type, ZSM-5 type and ZSM-11 type zeolites. To prevent coloration of the polymer at the spinning step and enhance the dispersibility of the silver-substituted zeolite, the $SiO_2/Al_2O_3$ molar ratio of the zeolites is preferably as high as possible, i.e., at least 15.

The silver-substituted zeolite is prepared by substituting a silver ion for an alkali metal ion or alkaline earth metal ion at the ion-exchangeable sites of a zeolite through an ion exchange reaction. More specifically, a zeolite is treated with an aqueous solution of a water-soluble silver compound whereby the ion exchange is effected. If desired, a divalent metal ion such as a copper ion or a zinc ion may be used in combination with a silver ion whereby an antibacterial and antifungal composite zeolite containing silver and the divalent metal is prepared. Even when such an antibacterial and antifungal composite zeolite is used, the substantially water-soluble soluble copper compound must be present independent of zeolite particles in the fiber for providing the dyed fiber having satisfactory antibacterial and antifungal properties.

The amount of silver ion to be substituted for the alkali metal ion or alkaline earth metal ion of a zeolite varies depending upon the particular structure and $SiO_2/Al_2O_3$ molar ratio of the zeolite, but is usually in the range of from 0.1 to 20% by weight based on the silver-substituted zeolite.

The amount of the silver-substituted zeolite in the fiber is from 0.01 to 20% by weight, preferably from 0.05 to 5% by weight and more preferably 0.1 to 1% by weight based on the weight of the fiber. If the amount of the silver-substituted zeolite is less than 0.01% by weight, the intended antibacterial and antifungal properties cannot be obtained. In contrast, if the amount of the silver-substituted zeolite exceeds 20% by weight, it is difficult to spin the polymer into a fiber and the coloration of the polymer becomes prominent.

The silver-substituted zeolite is incorporated into a monomer before the initiation of polymerization or a polymerization mixture before the completion of polymerization because the zeolite particles are finely and uniformly dispersed in the polymer.

As a modification of the procedure for preparing the silver-substituted zeolite-incorporated polymer, a procedure can be employed in which a relatively large amount of the silver-substituted zeolite is incorporated in a monomer or a polymerization mixture before the completion of polymerization to prepare a master polymer containing the silver-substituted zeolite at a concentration higher than that desired for the fiber, and the thus-prepared master polymer is incorporated with a polymer for the fiber, which is substantially free from the silver-substituted zeolite, before the spinning into a fiber. The amount of the silver-substituted zeolite is usually 5 to 30% by weight based on the weight of the master polymer. This master polymer-using procedure is advantageous in that the coloration of the polymer occurring when spun into a fiber due to the presence of the silver-substituted zeolite can be minimized.

The as-polymerized polymer is yellow-colored due to silver ion slightly dissolved out from the silver-substituted zeolite, and the degree of yellowness increases with the heightening of the concentration of the silver-substituted zeolite and reaches the uppermost limit thereof when the concentration of the silver-substituted zeolite is larger than 3% by weight, especially larger than 5% by weight based on the polymer. The higher the concentration of the silver-substituted zeolite in the master polymer is, the lower the ratio can be at which the master polymer is incorporated with the polymer substantially free from the silver-substituted zeolite. The lowering of the incorporation ratio of the master polymer leads to reduction in the degree of yellowness of the polymer and enhancement in the appearance of the fiber. Thus, an antibacterial and antifungal dyed fiber having a bright color tone without dullness can be obtained.

The higher the concentration of the silver-substituted zeolite in the master polymer, the more prominent the effect of improving the color tone of the fiber as above mentioned. However, a too high concentration of the silver-substituted zeolite results in deterioration in shapability of the polymer to an appreciable extent, and therefore, the maximum permissible concentration of the silver-substituted zeolite in the master polymer is 30% by weight.

Even though the master polymer containing a salient amount of the silver-substituted zeolite is incorporated with a polymer substantially free from the silver-substituted zeolite before spinning into a fiber, the intended level of antibacterial and antifungal action can be obtained provided that the mixed polymer contains 0.01 to 20% by weight of the silver-substituted zeolite, and consequently, the intended dyed fiber having satisfactory antibacterial and antifugal properties can be obtained.

The substantially water-insoluble copper compound includes, for example, copper halides such as cuprous chloride, cuprous iodide, cupric iodide and cuprous bromide, copper salts of an inorganic acid such as copper carbonate, copper oxide, and copper salts of an organic acid such as copper acetate, copper succinate and copper benzoate. An optimum substantially water-soluble copper compound varies according to the polymer for the fiber, and, more specifically, is selected from the copper compounds which are soluble and finely dispersible in the polymer. For example, where the polymer for the fiber is a polyamide, copper halides, especially copper iodide is most preferable.

The amount of the substantially water-insoluble copper compound is in the range of from 0.001 to 1.0% by weight, preferably 0.005 to 0.5% by weight and more preferably 0.01 to 0.1% by weight, based on the weight of the fiber. If the amount of the copper compound is too small, it is difficult to prevent degradation in the antibacterial and antifungal action of the dyed fiber. In contrast, if the amount of the copper compound is too large, yarn breakage or other troubles occur at the fiber-making step and the coloration of the polymer becomes prominent with the result of deterioration in quality of the dyed fiber.

To assist dissolution or dispersion of the copper compound in the polymer and stabilize the copper compound in the polymer, an assistant may be added, although the addition is not indispensable. As the assistants, there can be mentioned alkali halides, for example, potassium iodide, sodium iodide, potassium bromide and sodium bromide. Of these, potassium halide is preferable. The amount of the alkali halides is usually from 0.001 to 1.0% by weight and preferably from 0.01 to 0.1% by weight based on the weight of the fiber. Practically, the amount of the alkali halides may be approximately equimolar to the copper compound. The alkali halides have a function of stabilizing the copper compound in the polymer and to prevent coloration of the polymer due to the copper compound.

The substantially water-insoluble copper compound is incorporated in the polymer by an appropriate procedure after the completion of polymerization but before the spinning into a fiber. The incorporation procedure may suitably be selected depending upon the characteristics of the copper compound. For example, where the copper compound is capable of being finely divided to an extent such that the fiber-formation can be carried out without any trouble, a powder of the copper compound is mixed thoroughly together with the polymer usually in a pellet form, followed by spinning into a fiber. Where the copper compound is soluble in a solvent, a concentrated solution of the copper compound in the solvent is sprayed on the polymer and then dried.

As a modification of the procedure for preparing the copper compound-incorporated polymer, a procedure can be employed in which a relatively large amount of the copper compound is incorporated in the polymer to prepare a master polymer containing the copper compound at a concentration higher than that desired for the fiber, and the thus-prepared master polymer is incorporated with a base polymer for the fiber, which is substantially free from the copper compound, before the spinning into a fiber. The amount of the copper compound in the master polymer is usually from 0.5 to 10% by weight based on the weight of the master polymer. This master polymer-using procedure is advantageous in that the dispersibility of the copper compound is enhanced and the occurrence of color mottles due to uneven mixing can be prevented, and furthermore, the stagnation of the copper compound within a spinning apparatus can be avoided and the spinnability is enhanced.

The above-mentioned procedure using a master polymer containing a large amount of the silver-substituted zeolite and the above-mentioned procedure using a master polymer containing a large amount of the copper compound can be employed in combination. For example, an antibacterial and antifungal master polymer containing 5 to 30% by weight of the silver-substituted zeolite, but not containing the copper compound, a master polymer containing 0.5 to 10% by weight of the copper compound, but not containing the silver-substituted zeolite, and, if desired, a polymer containing neither the silver-substituted zeolite nor the copper compound can be mixed together to prepare a polymer containing 0.01 to 20% by weight of the silver-substituted zeolite and 0.001 to 1.0% by weight of the copper compound.

Alternatively, a master polymer containing 5 to 30% by weight of the silver-substituted zeolite and 0.5 to 10% by weight of the copper compound can be mixed with a polymer containing neither the silver-substituted zeolite nor the copper compound or a polymer containing either the silver-substituted zeolite or the copper compound to prepare a polymer containing 0.01 to 20% by weight of the silver-substituted zeolite and 0.001 to 1.0% by weight of the copper compound. In this case, the master polymer can be composed of a polymer such that the silver-substituted zeolite and/or the copper compound is readily dispersed therein, and the base polymer to be incorporated with the master polymer can be composed of a different kind of polymer. For example, the master polymer is prepared from a polyamide and the polyamide master polymer is incorporated with a large amount of a polyester as the base polymer to obtain an antibacterial and antifungal polyester fiber.

The polymer used for the formation of the synthetic fiber in which the substantially water-insoluble copper compound is present independent of zeolite particles is not particularly limited provided that the synthetic fiber is dyeable with dyes, for example, acid dyes such as an acid dye (in a narrow sense) and a metallized dye. As the polymer, there can be mentioned polyamide, polyester, polyacrylonitrile and copolymers thereof. Of these, polyamide is preferable. As the polyamide, there can be mentioned poly-ϵ-caprolactam (nylon-6), polylaurolactam (nylon-12), and polyamides prepared from a diamine and a dicarboxylic acid, such as polyhexamethylene adipamide. Copolyamides prepared from these polyamides and a copolymerizable diamine, dicarboxylic acid or lactam can also be used.

Conventional additives such as heat stabilizers, light stabilizers, dispersants and anti-static agents can be added to the polymer unless the additives are reacted with a silver ion and a copper ion to reduce the intended antibacterial and antifungal effect to any appreciable extent.

The synthetic fiber can be made by a process appropriate to the polymer, which may be a conventional melt spinning, wet spinning or dry spinning process, and can be dyed by an ordinary dyeing process.

Dyes which are generally used for synthetic fibers can be employed and include disperse dyes, acid dyes, basic dyes and direct dyes. Of these, acid dyes such as an acid dye in a narrow sense and a metallized dye are preferable. Acid dyes are generally used in an acidic bath for dyeing polyamide fibers. Metallized dyes are metal complex dyes composed of a dyestuff coordinated with a metal atom such as chromium, copper, cobalt or iron and, as the dyestuff, an acid dye, a mordant dye and an acid mordant dye are usually used.

As typical examples of the metallized dyes, there can be mentioned 1:2 type metallized dyes such as Irgalan Yellow GRL, Irgalan Red 4GL, Irgalan Blue 3GL, Irgalan Brown 2GL and Irgalan Black BGL, supplied by Chiba-Geigy (Japan) Ltd.; Kayakalan Yellow GL, Kayakalan Brown GL, Kayakalan Red BL, Kayakalan Olive GL and Kayakalan Black BGL, supplied by Nippon Kayaku Co.; Lanafast Khaki GL, Lanafast Brown BL and Lanafast Grey BGL, supplied by Mitsui Toastsu Dyes Inc.; Lannyl Blue 3G, Lannyl Brown R and Lannyl Black BG, supplied by Sumitomo Chemical Co.; and 1:1 type metallized dyes such as Neolan Yellow E-2R, Neolan Red GRE, Neolan Blue 3R, Neolan Green E-3GL, Neolan Brown E-5GL and Neolan Black WA, supplied by Chiba-Geigy (Japan) Ltd.; Sumilan Black WA supplied by Sumitomo Chemical Co.; and Palatin Fast Yellow ELN, Palatin Fast Red GREN, Palatin Fast Violet SRN, Paratin Fast Blue GGN, Palatin Fast Green BLN and Palatin Fast Black WAN, supplied by BASF Japan Ltd.

As typical examples of the acid dyes in a narrow sense,there can be mentioned Diacid Fast Yellow R, Diacid Fast Red 3BL and Diacid Fast Black BR, supplied by Mitsubishi Kasei Corp.; Kayanol Yellow NFG, Kayanol Red NBR and Kayanol Blue NR, supplied by Nippon Kayaku Co.; Mitsui Nylon Fast Yellow 5G, Mitsui Nylon Fast Red BB and Mitsui Nylon Fast Blue G, supplied by Mitsui Toatsu Dyes Inc.; Nylosan Yellow N5GL, Nylosan Red N-GZ, Nylosan Blue N-GFL and Nylosan Navy N-RBL, supplied by Sandoz Co.; and Suminol Milling Yellow 3G, Suminol Milling Red G, Suminol Milling Brown 3G and Suminol Milling Black B, supplied by Sumitomo Chemical Co.

If desired, the dyed synthetic fiber of the present invention and textile fabrics made therefrom may be subjected to a finishing treatment such a as water-repelling, anti-static or softening treatment. Even when the finishing treatment is carried out, the reduction of the antibacterial and antifungal effect occurring at the finishing step is only to a very slight extent in the fiber and fabrics wherein the copper compound is present independent of zeolite particles.

It is crucial in the dyed fiber of the present invention that the substantially water-insoluble copper compound is present independent of zeolite particles to minimize the reduction of the antibacterial and antifungal effect to a very slight extent. If a composite zeolite having both silver and copper substituted therein by an ion exchange is used, the reduction of the antibacterial and antifungal effect occurs to an appreciable extent and thus the dyed fiber and fabrics do not retain satisfactory antibacterial and antifungal properties.

It is important in the process of the present invention that the copper compound is incorporated in the polymer after the completion of polymerization but before the spinning into a fiber. By this process, a polymer wherein the copper compound is present independent of zeolite particles can be obtained in an industrially advantageous manner.

If the copper compound is incorporated together with the silver-substituted zeolite in a monomer or a polymerization mixture before the completion of polymerization, a copper ion is substituted for an alkali metal or alkaline earth metal of the zeolite through an ion exchange reaction during the polymerization. Therefore, to render a predetermined amount of the copper compound present independent of the silver-substituted zeolite particles in the polymer, an excessive amount of the copper compound must be added and consequently undesirable coloration and discoloration with time of the fiber occur.

Silver-substituted zeolites exhibit an excellent antibacterial and antifungal action as compared with zeolites substituted with another metal such as copper, and therefore, an antibacterial and antifungal effect of the desired magnitude can be obtained with a small amount of the silver-substituted zeolites. However, where the polymer having incorporated therein the silver-substituted zeolite is spun into a fiber and the fiber is dyed, the antibacterial and antifungal effect is reduced during the dyeing of the fiber. This reduction of the antibacterial and antifungal effect is prominent when the fiber is dyed with acid dyes, especially with a metallized dye. One reason therefor would be such that a silver ion gradually released from the antibacterial and antifungal zeolite is trapped by a sulfone group of an acid dye and, especially when the fiber is dyed with a metallized dye, the released silver ion is further substituted for a metal ion, such as chromium ion, of the dye or bonded to residual electric charge sites of the dye to form a complex.

In contrast, in the dyed fiber of the present invention wherein the copper compound is present independent of zeolite particles, a copper ion released from the copper compound is readily trapped by a sulfone group of an acid dye and, when dyed with a metallized dye, the copper ion is readily substituted for the metal ion of the dye or bonded to residual electric charge sites of the dye to form a stable complex, and therefore, a silver ion released from the zeolite is trapped by the sulfone group, substituted for the metal ion or form a complex only to a slight degree.

The dyed fiber of the present invention has a good resistance to bacteria and fungi including eumycetes. As the bacteria, there can be mentioned, for example, *Staphylococcus aureus, Escherichia coli, Bacillus subtilis, Klebsiella pneumoniae* and *Pseudomonas aeruginosa*. As the eumycetes, there can be mentioned, for example, *Candida albicans* and *Trichophyton mentagrophytes*.

The dyed fiber of the present invention retains good antibacterial and antifungal properties and this is prominent where the fiber is dyed with acid dyes such as a metallized dye. Furthermore, even when the dyed fiber is subjected to a finishing treatment, the reduction of the antibacterial and antifungal effect is only to a very slight extent, and therefore, the dyed fiber is especially useful for clothing, interior decorations and other textile articles, in which a finishing treatment is indispensable.

The present invention will now be described by the following examples that by no means limit the scope of the invention.

EXAMPLE 1

Mordenite zeolite particles having an $SiO_2/Al_2O_3$ molar ratio of 17 were treated with an aqueous solution of silver nitrate to prepare an antibacterial and antifungal silver-substituted zeolite particles containing 7.5% by weight of an silver ion.

To ε-caprolactam, 0.3% by weight, based on the ε-caprolactam, of the silver-substituted zeolite particles were added, followed by polymerization of the ε-caprolactam by a conventional process to yield a pellet of antibacterial and antifungal nylon-6 having a relative viscosity of 2.75 as measured in 98% sulfuric acid.

To the nylon-6 pellet, 0.05% by weight, based on the nylon-6 pellet, of a powdery copper compound (cuprous iodide, cuprous bromide or copper benzoate) was added and the blend was thoroughly mixed and dried. The mixture was melt-spun by an ordinary procedure to yield a nylon-6 filament yarn (30 denier/6 filaments). The resultant filament yarns containing cuprous iodide, cuprous bromide and copper benzoate as the copper compound are called filament yarns No. 1, No. 2 and No. 3, respectively.

The filament yarn No. 1 was dissolved in a phenol/methanol (3:1) mixed solvent whereby cuprous iodide was separated. Thus, cuprous iodide could be recovered in substantially the same amount as that added to the nylon-6 pellet.

As a modified process, 0.05% by weight of a powdery cuprous iodide and 0.05% by weight of potassium iodide were added to the above-mentioned antibacterial and antifungal nylon-6 pellet, and the blend was mixed, dried and melt-spun into a filament yarn by the same procedures as mentioned above. The resultant filament yarn is called filament yarn No. 4.

For comparison purposes, a nylon-6 filament yarn wherein the silver-substituted zeolite particles were incorporated in the same manner as mentioned above, but the copper compound was not incorporated, and a nylon-6 filament yarn wherein cuprous iodide was incorporated in the same manner as mentioned above, but the silver-substituted zeolite particles were not incorporated, were made by procedures similar to those mentioned above. These nylon-6 filament yarns are called filament yarns No. 5 and No. 6, respectively.

For another comparison purpose, a nylon-6 filament yarn wherein neither the silver-substituted zeolite nor the copper compound was incorporated was made by similar procedures. The nylon-6 filament yarn is called filament yarn No. 7.

Each of filament yarns No. 1 through No. 7 was subjected to a warping and knitted into a half-tricot having a 32 gauge. The half-tricot was dyed with Kayakalan Black BGL (1:2 type metallized dye, supplied by Nippon Kayaku Co.) at 0.8% owf and then fix-treated with Dimafix ESH (supplied by Meisei Chemical Industry Co.).

Another half-tricot knitted from filament yarn No. 2 was dyed with Sumilan Black WA (1:1 type metallized dye, supplied by Sumitomo Chemical Co.) at 0.8% owf and fix-treated in the same manner. The thus-treated fabric is called fabric No.8. Still another half-tricot knitted from filament yarn No. 2 was dyed with Nylosan Blue N-GFL (acid dye, supplied by Sandoz Co.) at 0.8% owf and 98° C. for 60 minutes. The thus-dyed fabric is called fabric No. 9.

Antibacterial properties of the half-tricot fabrics were evaluated before and after the fabrics were dyed according to the following shake-flask method.

A buffered suspension of a test bacterium (Staphylococcus aureus, IFO 12732) was added to each fabric sample and the mixture was shaken at a rate of 150 times/minute for 1 hour in a closed vessel. After the shaking, the number of living bacteria was measured and the extinction rate of bacteria was calculated according to the following formula.

$$\text{Extinction rate } (\%) = (A - B) \times 100/A$$

wherein A is the number of living bacteria in the added suspension, and B is the number of living bacteria as measured after shaking.

The results are shown in Tables 1 and 2.

TABLE 1

| No. of filament yarn or fabric | Ag-substituted zeolite | Copper compound | Extinction rate (%) Knitted fabric before dyeing | Knitted fabric after dyeing |
|---|---|---|---|---|
| 1 | Added | CuI | 91 | 86 |
| 2 | Added | CuBr | 95 | 81 |
| 3 | Added | Cu benzoate | 89 | 79 |
| 4 | Added | CuI + KI | 93 | 87 |
| 5* | Added | Not added | 92 | 3 |
| 6* | Not added | CuI | 3 | 2 |
| 7* | Not added | Not added | 4 | 3 |

*Comparative Examples

TABLE 2

| No. of filament yarn or fabric | Dye | Extinction rate (%) CuBr added Knitted fabric | Knitted fabric | CuBr not added Knitted fabric |
|---|---|---|---|---|
| 2 | 1:2 type metallized | 95 | 81 | 3 |
| 8 | 1:1 type metallized | 97 | 82 | 30 |
| 9 | acid | 98 | 95 | 50 |

As seen from Table 1, knitted fabrics No. 1 through No. 4, in which the copper compound was present independent of zeolite particles, exhibited a good antibacterial property even after the dyeing. In contrast, knitted fabric No. 5, in which the silver-substituted zeolite was incorporated but the copper compound was not incorporated, did not exhibit an antibacterial property to any appreciable extent after the dyeing, although it exhibited a good antibacterial property before the dyeing. Knitted fabrics No. 6 and No. 7, in which the silver-substituted zeolite was not incorporated, did not exhibit an antibacterial property even before the dyeing.

As seen from Table 2, the degree of reduction in the antibacterial action due to the dyeing varied depending upon the particular dye. However, when the copper compound was incorporated in combination with the silver-substituted zeolite, the reduction of the antibacterial property could be minimized.

EXAMPLE 2

By the same procedures as those employed for the preparation of filament yarn No. 1 in Example 1, nylon-6 filament yarn No. 10 was prepared wherein the amount of the silver-substituted zeolite added was changed to 0.2% by weight, the relative viscosity of nylon-6 was 2.72 as measured in 98% surfuric acid, and 0.05% by potassium iodide was added in combination with 0.05% by weight of cuprous iodide. When nylon-6 filament yarn No. 10 was dissolved in a solvent and cuprous iodide was separated in the same manner as described in Example 1, cuprous iodide could be recovered in substantially the same amount as that added to the nylon-6 pellet.

For comparison purposes, nylon-6 filament yarn No. 11, in which a silver- and copper-substituted composite zeolite was incorporated but a copper compound was not incorporated, was prepared as follows. Y-type zeolite particles having an $SiO_2/Al_2O_3$ molar ratio of 5.0 were treated with an aqueous solution of silver nitrate and copper sulfate to prepare a silver- and copper-substituted composite zeolite particles containing 5.8% by weight of a silver ion and 6.2% by weight of a copper ion. To ε-caprolactam, 0.3% by weight of the composite zeolite particles was added, followed by polymerization in the same manner as in Example 1 to yield a nylon-6 pellet having a relative viscosity of 2.72 as measured in 98% surfuric acid. The pellet was melt-spun into a fiber in the same manner as in Example 1 except that the copper compound was not added.

Half-tricot fabrics were knitted from nylon-6 filament yarns No. 10 and No. 11 and dyed, and the antibacterial properties were evaluated, by the same procedures as described Example 1. The results are shown in Table 3.

TABLE 3

| No. of filament yarn | Addition procedure of copper compound | Extinction rate (%) Knitted fabric before dyeing | Knitted fabric after dyeing |
|---|---|---|---|
| 10 | Powder blending with Ag-subst. zeolite-containing polymer | 95 | 90 |
| 11* | Substituted together with Ag for metal of zeolite | 98 | 3 |

*Comparative Example

As seen from Table 3, a fabric knitted from nylon-6 filament yarn No. 11, which was prepared by adding the silver-substituted zeolite before the completion of polymerization and blending the polymer with a powdery copper compound, exhibited a good antibacterial property even after the dyeing because the copper compound was present as particles independent of zeolite particles in the fiber.

In contrast, a fabric knitted from nylon-6 filament yarn No. 11, which was prepared by adding a silver- and copper-substituted composite zeolite, but not adding a copper compound, did not exhibit an antibacterial property to any appreciable extent after the dyeing because the antibacterial action was greatly reduced during the dyeing.

EXAMPLE 3

By the same procedures as those employed in Example 1, nylon-6 filament yarn No. 12 was prepared wherein a mordenite type zeolite having an $SiO_2/Al_2O_3$ molar ratio of 17.0 was treated with an aqueous solution of silver nitrate and copper sulfate to yield a silver- and copper-substituted zeolite containing 2.0% by weight of a silver ion and 4.0% by weight of a copper ion; 0.7% by weight of the composite zeolite was added to ε-caprolactam; and the ε-caprolactam was polymerized to yield a nylon-6 pellet having a relative viscosity of 2.72 as measured in 98% sulfuric acid. Cuprous iodide and potassium iodide were incorporated in the nylon-6 pellet and the mixture was melt-spun into a fiber in the same manner as that employed for the preparation of filament yarn No. 4 in Example 1.

A half-tricot was knitted from filament yarn No. 12 and dyed, and the antibacterial property was evaluated, in the same manner as described in Example 1. The dyed halftricot had an extinction rate of 86%.

EXAMPLE 4

The same mordenite type zeolite particles as those used in Example 1 were treated with an aqueous solution of silver nitrate to yield silver-substituted zeolite particles containing 10.2% by weight of a silver ion. The siver-substituted zeolite particles were added to ε-caprolactam at a concentration shown in Table 4, followed by polymerization to yield an antibacterial and antifungal nylon-6 master pellet. The antibacterial and antifungal nylon-6 master pellet was thoroughly mixed together with an ordinary nylon-6 pellet, to which the silver-substituted zeolite had not been added, at a ratio such that the concentration of the silver-substituted zeolite particles is 0.3% by weight, and the mixture was dried. To the mixture, 0.03% by weight of a powdery cuprous iodide and 0.03% by weight of a powdery potassium iodide were added and the resultant mixture was melt-spun in a conventional manner to form an antibacterial and antifungal nylon-6 filament yarn (30 denier/10 filaments). The thus-prepared filament yarns are called filament yarns No. 13 through No. 17. Note, filament yarn No. 13 was prepared by not adding the ordinary nylon-6 pellet, i.e., by using alone the as-polymerized antibacterial and antifungal nylon-6 pellet.

Filament yarns No. 13 through No. 17 were knitted into half-tricots and the half-tricots were dyed and fix-treated in the same manner as in Example 1.

The antibacterial properties of the half-tricots were evaluated by the same procedure as in Example 1. The color tone (i.e., yellowness) of the as-polymerized antibacterial and antifungal nylon-6 pellets (which had a columnar shape having a diameter of 1.3 mm and a length of 2.5 mm) and the filament yarns were measured by using a differential colorimeter (Sigma 80 supplied by Nippon Denshoku Kogyo k.k.). The larger the yellowness value, the larger the undesirable coloration.

TABLE 4

| No. of filament yarn | Antibacterial pellet Concentration of Ag-zeolite | Yellowness | Yellowness of filament yarn | Antibacterial action (Extinction rate, %) |
|---|---|---|---|---|
| 13 | 0.3 | 39.4 | 41.8 | 78 |
| 14 | 3.0 | 51.9 | 37.2 | 80 |
| 15 | 10.0 | 54.2 | 24.9 | 82 |
| 16 | 20.0 | 52.4 | 10.2 | 82 |
| 17 | 35.0 | 53.0 | 8.4 | 81 |

As seen from Table 4, all of the dyed fabrics made from filament yarns No. 13 through No. 17 exhibited a good antibacterial property. With regard to the filament yarns, the larger the content of the silver-substituted zeolite particles in the antibacterial pellet, the smaller the yellowness value of the filament yarn. The smaller the yellowness value of the filament yarn, the better the color tone of the knitted fabric.

A piece of lingerie was made from the half-tricot of filament yarn No. 15 and its wearing test was conducted wherein a wearing for 24 hours and laundering were repeated 10 times and thereafter the antibacterial action was measured. The extinction rate was 90%.

EXAMPLE 5

To an ordinary nylon-6 pellet in which a silver-substituted zeolite had not been added, 2.5% by weight of cuprous iodide and 2.5% by weight of potassium iodide were added, and the mixture was melt-kneaded in an extruder and shaped into a master pellet containing a salient amount of the copper compound.

The master pellet was mixed thoroughly together with the antibacterial silver-substituted nylon-6 pellet containing 0.3% by weight of the silver-substituted zeolite, which pellet was prepared in Example 1, and the pellet mixture was dried to give a pellet for spinning containing 0.03% by weight of cuprous iodide, 0.03% by weight of potassium iodide and 0.3% by weight of the silver-substituted zeolite. The resultant pellet was melt-spun by a conventional procedure into an antibacterial nylon-6 filament yarn (50 denier/17 filaments).

The nylon-6 filament yarn was subjected to a circular knitting, and the resultant fabric was dyed and fix-treated, and the antibacterial property was evaluated, in the same manner as in Example 1. The extinction rate was 83%.

In this example, a procedure was adopted wherein a master pellet containing salient amounts of cuprous iodide and potassium iodide was first prepared and then incorporated with another pellet containing neither cuprous iodide nor potassium iodide, and therefore, the dispersibility of cuprous iodide and potassium iodide in the fiber was enhanced and the uniformity in color was improved.

EXAMPLE 6

(a) the master pellet containing 10% by weight of the silver-substituted zeolite, which pellet was prepared for the preparation of filament yarn No. 15 in Example 4, (b) the master pellet containing a salient amount of the copper compound, which was prepared in Example 5, and (c) an ordinary nylon-6 pellet containing neither the silver-substituted zeolite nor the copper compound were mixed together at a proportion of (a)/(b)/(c)=5:2:133 by weight to yield a pellet for spinning containing 0.3% by weight of the silver-substituted zeolite, 0.03% by weight of cuprous iodide and 0.03% by weight of potassium iodide. The pellet was melt-spun in the same manner as in Example 4 to yield an antibacterial nylon-6 filament yarn (15 denier, 5 filaments). The yellowness value of the filament yarn was 23.2.

The leg parts of stockings were knitted from the antibacterial nylon-6 filament yarn by feeding the same number of an ordinary single covering yarn and an elastic covering yarn, each yarn being through two feeds, and the panty part thereof was knitted from an ordinary false-twisted nylon-6 filament yarn (30 denier/6 filaments). The as-knitted stockings were dyed with a 1:3 type metallized dye (Kayakalan Brown GL, supplied by Nippon Kayaku Co.) at 0.8% owf, then fix-treated with Sun-life E-7 supplied by Nikka Kagaku Kogyo K.K., and thereafter, finished with a softener (Softener TO, supplied by Takamatsu Yushi K.K.) to give finished stockings.

The antibacterial property of the stockings was evaluated. The extinction rate was 72%.

What is claimed is:

1. A dyed synthetic polyamide fiber having antibacterial and antifungal properties which comprises, based on the weight of the fiber, 0.01 to 20% by weight of a silver-substituted zeolite exhibiting antibacterial and antifungal action and 0.001 to 1.0% by weight of a substantially water-insoluble copper compound, said substantially water-insoluble copper compound being present independent of zeolite particles in the fiber and the fiber being dyed with an acid or a metallized dye and having a maximum water solubility in water of 100 mg per 100 g of water at a temperature of 20° C.

2. A dyed synthetic polyamide fiber according to claim 1, wherein the fiber is dyed with an acid dye.

3. A dyed synthetic polyamide fiber according to claim 1, wherein the fiber further comprises 0.001 to 1.0% by weight, based on the weight of the fiber, of an alkali halide.

4. A dyed synthetic polyamide fiber according to claim 1, wherein the copper compound is at least one compound selected from the group consisting of cuprous chloride, cuprous iodide, cuprous bromide, copper carbonate, copper oxide, and copper benzoate.

5. A dyed synthetic polyamide fiber according to claim 1, wherein the copper compound is at least one copper halide selected from the group consisting of cuprous chloride, cuprous iodide and cuprous bromide.

6. A dyed synthetic polyamide fiber according to claim 1, wherein the copper compound is cuprous iodide.

7. A dyed synthetic polyamide fiber according to claim 1 wherein the silver-substituted zeolite has an $SiO_2/Al_2O_3$ molar ratio of at least 15.

8. A dyed synthetic polyamide fiber according to claim 1, wherein the amount of the silver-substituted zeolite is from 0.05 to 5% by weight based on the weight of the fiber.

9. A dyed synthetic polyamide fiber according to claim 1, wherein the amount of the copper compound is from 0.005 to 0.5% by weight based on the weight of the fiber.

10. A dyed synthetic polyamide fiber according to claim 3, wherein the fiber comprises, based on the weight of the fiber, 0.1 to 1% by weight of a silver-substituted zeolite, 0.01 to 0.1% by weight of a copper halide and 0.01 to 0.1% by weight of a potassium halide.

11. A dyed synthetic polyamide fiber according to claim 1 wherein the silver-substituted zeolite contains from 0.1 to 20% by weight silver.

12. A process for preparing a dyed synthetic polyamide fiber having antibacterial and antifungal properties, which comprises the steps of:

incorporating a silver-substituted zeolite exhibiting antibacterial and antifungal action in a polyamide monomer or a polymerization reaction mixture before completion of polymerization in the step of preparing a polymer for the synthetic fiber;

further incorporating a substantially water-insoluble copper compound in the polymer before spinning thereof into a fiber, to prepare a polymer containing, based on the weight of the polymer, 0.01 to 20% by weight of the silver-substituted zeolite and 0.001 to 1.0% by weight of the copper compound, said copper compound being present independent of zeolite particles in the polymer;

spinning the thus-prepared polymer into a fiber; and dyeing the fiber with an acid or a metallized dye.

13. A process according to claim 12, wherein 5 to 30% by weight, based on the weight of the synthetic polyamide polymer, of the silver-substituted zeolite is incorporated in the monomer or the polymerization mixture before the completion of polymerization and the thus-prepared polymer is incorporated with a polymer for the synthetic polyamide fiber, which is substantially free from the silver-substituted zeolite, to thereby prepare the polyamide polymer containing, based on the weight of the polymer, 0.01 to 20% by weight of the silver-substituted zeolite and 0.001 to 1.0% by weight of the substantially water-insoluble copper compound.

14. A process according to claim 12, wherein 0.5 to 10% by weight, based on the weight of the polyamide polymer, of the substantially water-insoluble copper compound is incorporated in the polymer and the thus-prepared polymer is incorporated with a polymer for the synthetic polyamide fiber, which is substantially free from the copper compound, to thereby prepare the polymer containing, based on the weight of the polymer, 0.01 to 20% by weight of the silver-substituted zeolite and 0.001 to 1.0% by weight of the substantially water-insoluble copper compound.

15. A process according to claim 12, wherein 5 to 30% by weight, based on the weight of the synthetic polyamide polymer, of the silver-substituted zeolite is incorporated in the monomer or the polymerization mixture before the completion of polymerization; 0.5 to 10% by weight, based on the weight of the polymer, of the substantially water-insoluble copper compound is incorporated in the synthetic polyamide polymer; and the thus-prepared synthetic polyamide polymer is incorporated with a polymer for the synthetic polyamide fiber, which is substantially free from at least one of the silver-substituted zeolite and the substantially water-insoluble copper compound, to thereby prepare the synthetic polyamide polymer containing, based on the weight of the polymer, 0.01 to 20% by weight of the silver-substituted zeolite and 0.001 to 1.0% by weight of the substantially water-insoluble copper compound.

16. A process according to claim 12 further comprising addition of from 0.1 to 20% by weight of silver to a zeolite to produce the silver-substituted zeolite.

* * * * *